US006642463B1

(12) United States Patent
Turner

(10) Patent No.: US 6,642,463 B1
(45) Date of Patent: Nov. 4, 2003

(54) CIRCUIT BREAKER REMOTE ACTUATOR WITH FULCRUM MEMBER TO ASSIST ASSEMBLY AND ASSOCIATED METHOD

(75) Inventor: David C. Turner, Imperial, PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 10/160,333

(22) Filed: May 31, 2002

(51) Int. Cl.[7] ..... H01H 3/20; H01H 17/00; H01H 9/20

(52) U.S. Cl. ..... 200/331; 200/50.19

(58) Field of Search ..... 200/50.01–50.4, 200/329, 339

(56) References Cited

U.S. PATENT DOCUMENTS

| | | | | |
|---|---|---|---|---|
| 2,216,298 A | * | 10/1940 | Rowe | 200/50.18 |
| 2,760,021 A | * | 8/1956 | Cole et al. | 200/50.19 |
| 2,806,098 A | * | 9/1957 | Portman et al. | 200/50.19 |
| 3,801,765 A | * | 4/1974 | Hodgson | 200/401 |
| 4,107,488 A | * | 8/1978 | Keller et al. | 200/50.15 |
| 4,168,417 A | * | 9/1979 | Puetz et al. | 200/330 |
| 4,626,638 A | * | 12/1986 | Samples et al. | 200/331 |
| 5,319,168 A | | 6/1994 | Hutko et al. | |
| 5,628,394 A | | 5/1997 | Benke et al. | |
| 5,757,260 A | | 5/1998 | Smith et al. | |
| 5,973,279 A | * | 10/1999 | Turner et al. | 200/331 |
| 6,002,560 A | | 12/1999 | Nguyen et al. | |

* cited by examiner

*Primary Examiner*—J. R. Scott
(74) *Attorney, Agent, or Firm*—Martin J. Moran

(57) ABSTRACT

An improved remote actuator for use with a circuit breaker includes a handle assembly that can be disposed at the exterior of a cabinet and an actuation assembly that is operatively connected with the handle assembly and with the circuit breaker. The remote actuator includes a spring that is connected with a transfer link of the handle assembly and that biases a handle of the handle assembly to either an ON position or an OFF position. The remote actuator includes a fulcrum member on a bracket of the actuation assembly that at least partially overcomes the bias of the spring to facilitate assembly of the remote actuator.

15 Claims, 6 Drawing Sheets

CIRCUIT BREAKER REMOTE ACTUATOR WITH FULCRUM MEMBER TO ASSIST ASSEMBLY AND ASSOCIATED METHOD

BACKGROUND OF THE INVENTION

1. Field of the Invention

The present invention relates generally to power distribution equipment and, more particularly, to a remote actuator for a circuit breaker. Specifically, the invention relates to a remote actuator that includes a fulcrum member to assist assembly of the remote actuator, as well as an associated method.

2. Description of the Related Art

Molded case circuit breakers are generally used to provide overcurrent and under-voltage protection for various types of electrical equipment. In some application, however, it is desirable to have an operating device for the circuit breaker that is external to a circuit breaker enclosure. Such external operators facilitate the operation of circuit breakers. Such a remote control system is also useful for molded case switches.

In such applications, external operators have been provided that are adapted to be mechanically coupled with the operating handle of the circuit breaker or molded case switch. The external operator typically is in the form of an external handle or lever that is operatively connected with a cable. The cable is coupled to a mechanism mounted on the face of the circuit breaker. When the external handle is actuated, the cable acts on the attached mechanism which moves the circuit breaker operating handle between the ON and OFF positions.

External operators such as those described above typically have an undesirable level of lost motion or "backlash" that results from numerous mechanical parts that are connected in series. It thus is desirable to provide the external operator with a spring-biased over-center mechanism that biases the operating handle to either the ON position or the OFF position, as opposed to an intermediate position therebetween. Such spring-biased mechanisms have been difficult to assemble, however, due to the manually applied forces that are required to assemble the mechanism and the cramped confines of such mechanisms. It is thus desired to provide an improved remote actuator of the type that includes a spring, in which the remote actuator is specifically configured to at least partially overcome the bias of the spring during initial assembly of the remote actuator.

SUMMARY OF THE INVENTION

Accordingly, an improved remote actuator for use with a circuit breaker includes a handle assembly that can be disposed at the exterior of a cabinet and an actuation assembly that is operatively connected with the handle assembly and with the circuit breaker. The remote actuator includes a spring that is connected with a transfer link of the handle assembly and that biases a handle of the handle assembly to either an ON position or an OFF position. The remote actuator includes a fulcrum member on a bracket of the actuation assembly that at least partially overcomes the bias of the spring to facilitate assembly of the remote actuator.

Accordingly, an aspect of the present invention is to provide a remote actuator that permits the remote operation of a circuit breaker.

Another aspect of the present invention is to provide a circuit breaker remote actuator that is relatively easier to assemble than other known remote actuation systems.

Another aspect of the present invention is to provide a remote actuator that includes a fulcrum member that can be engaged with a transfer link of the remote actuator and that facilitates assembly of the remote actuator.

Accordingly, an aspect of the present invention is to provide a remote actuator, the remote actuator being structured to remotely operate a circuit breaker, in which the general nature of the remote actuator can be stated as including a handle assembly, the handle assembly including a handle, the handle assembly including a transfer link, the transfer link including a link attachment portion, the handle assembly including a spring, an actuation assembly, the actuation assembly including a bracket, the actuation assembly including a transmission assembly, the transmission assembly including a transmission attachment portion, the transmission assembly being structured to be operatively connected with the circuit breaker, the handle being operatively connected with the transfer link, the spring biasing the link attachment portion generally away from the transmission attachment portion, a fulcrum member, the fulcrum member being disposed on one of the handle assembly and the bracket, and the transfer link being engageable with the fulcrum member to at least partially overcome the bias of the spring and to facilitate operative connection of the transfer link with the transmission assembly by moving the link attachment portion from a first position at a first distance from the transmission attachment portion to a second position at a second distance from the transmission attachment portion, the second distance being less than the first distance.

Another aspect of the present invention is to provide a power distribution assembly, the general nature of which can be stated as including a cabinet, the cabinet including an interior, the cabinet including an exterior, a circuit breaker, the circuit breaker being disposed within the interior of the cabinet, a remote actuator, the remote actuator including a handle assembly, the remote actuator including an actuation assembly, the handle assembly including a handle, the handle assembly including a transfer link, the transfer link including a link attachment portion, the handle being operatively connected with the transfer link, the handle assembly including a spring, the actuation assembly including a bracket, the actuation assembly including a transmission assembly, the transmission assembly including a transmission attachment portion, the transmission assembly being operatively connected with the circuit breaker, the spring biasing the link attachment portion generally away from the transmission attachment portion, a fulcrum member, the fulcrum member being disposed on one of the handle assembly and the bracket, and the transfer link being engageable with the fulcrum member to at least partially overcome the bias of the spring and to facilitate operative connection of the transfer link with the transmission assembly by moving the link attachment portion from a first position at a first distance from the transmission attachment portion to a second position at a second distance from the transmission attachment portion, the second distance being less than the first distance.

Another aspect of the present invention is to provide a method of assembling a remote actuator, the general nature of which can be stated as including providing a handle assembly including a handle, a transfer link, and a spring, the transfer link being operatively connected with the handle, providing an actuation assembly including a bracket and a transmission assembly, biasing the transfer link away from the transmission assembly with the spring, providing a fulcrum member disposed on one of the handle assembly and the bracket, engaging the transfer link with the fulcrum member, at least partially overcoming the bias of the spring, and attaching the transfer link to the transmission assembly.

BRIEF DESCRIPTION OF THE DRAWINGS

A further understanding of the invention can be gained from the following description of the preferred embodiment when read in conjunction with the accompanying drawings in which.

Similar numerals refer to similar parts throughout the specification.

DESCRIPTION OF THE PREFERRED EMBODIMENT

Figure 1:
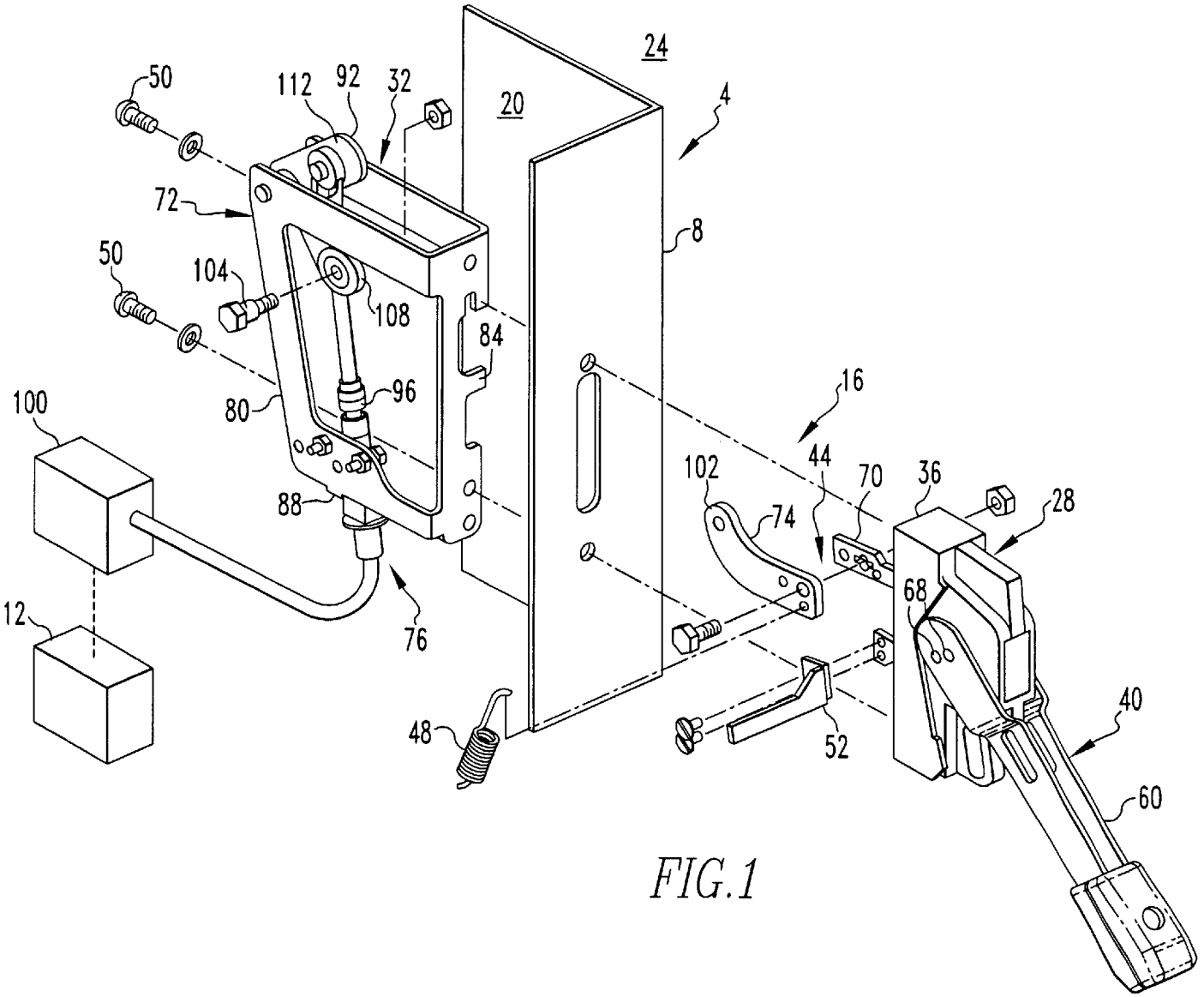
FIG. 1 is an exploded isometric view of a portion of a power distribution assembly in accordance with the present invention that includes a remote actuator in accordance with the present invention.
Figure 2:
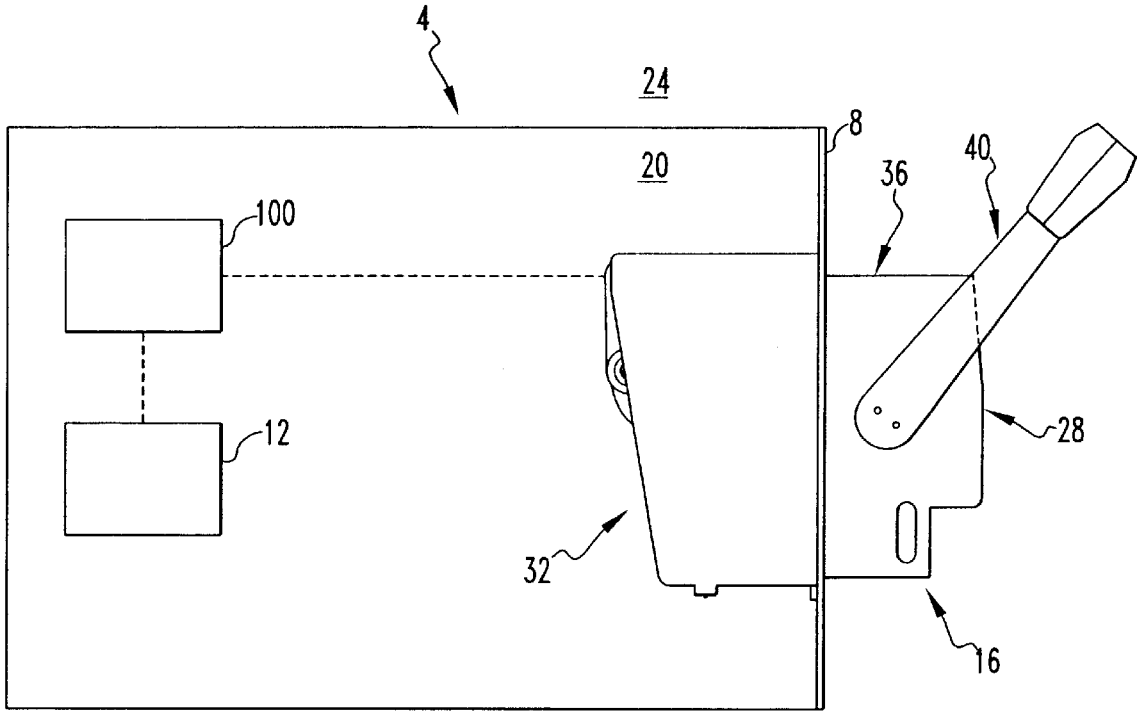
FIG. 2 is a schematic view, partially cut away, of the power distribution assembly.

A power distribution assembly 4 in accordance with the present invention is indicated generally in FIGS. 1 and 2. The power distribution assembly 4 includes a cabinet 8 (a portion of which is depicted in FIG. 1 and which is schematically depicted in FIG. 2), a circuit breaker 12 (schematically depicted in FIGS. 1 and 2), and a remote actuator 16 in accordance with the present invention. The remote actuator 16 advantageously permits the circuit breaker 12 which is disposed at the interior 20 of the cabinet 8 to be remotely operated from the exterior 24 of the cabinet 8. As will be set forth more fully below, the remote actuator 16 is advantageously configured to facilitate its own assembly.

The cabinet 8 is any of a wide variety of enclosures that are configured to receive and retain therein the circuit breaker 12 along with other associated equipment. The circuit breaker 12 is disposed in the interior 20 of the cabinet 8. The circuit breaker 12 may be any of a wide variety of known current interruption devices including circuit breakers, molded case switches, and the like.

The remote actuator 16 can be broadly stated as including a handle assembly 28 and an actuation assembly 32. The handle assembly 28 is operatively connected with the actuation assembly 32. At least a portion of the handle assembly 28 is disposed at the exterior 24 of the cabinet 8 and can be operated by a technician or other appropriate person to switch the circuit breaker 12 between an ON position and an OFF position. The actuation assembly 32 is disposed substantially within the interior 20 of the circuit breaker 12 and is operatively connected with the circuit breaker 12. It thus can be understood that motion of the handle assembly 28 is transferred by the actuation assembly 32 to the circuit breaker 12 to operate the circuit breaker 12 between the ON and OFF positions.

Figure 3:
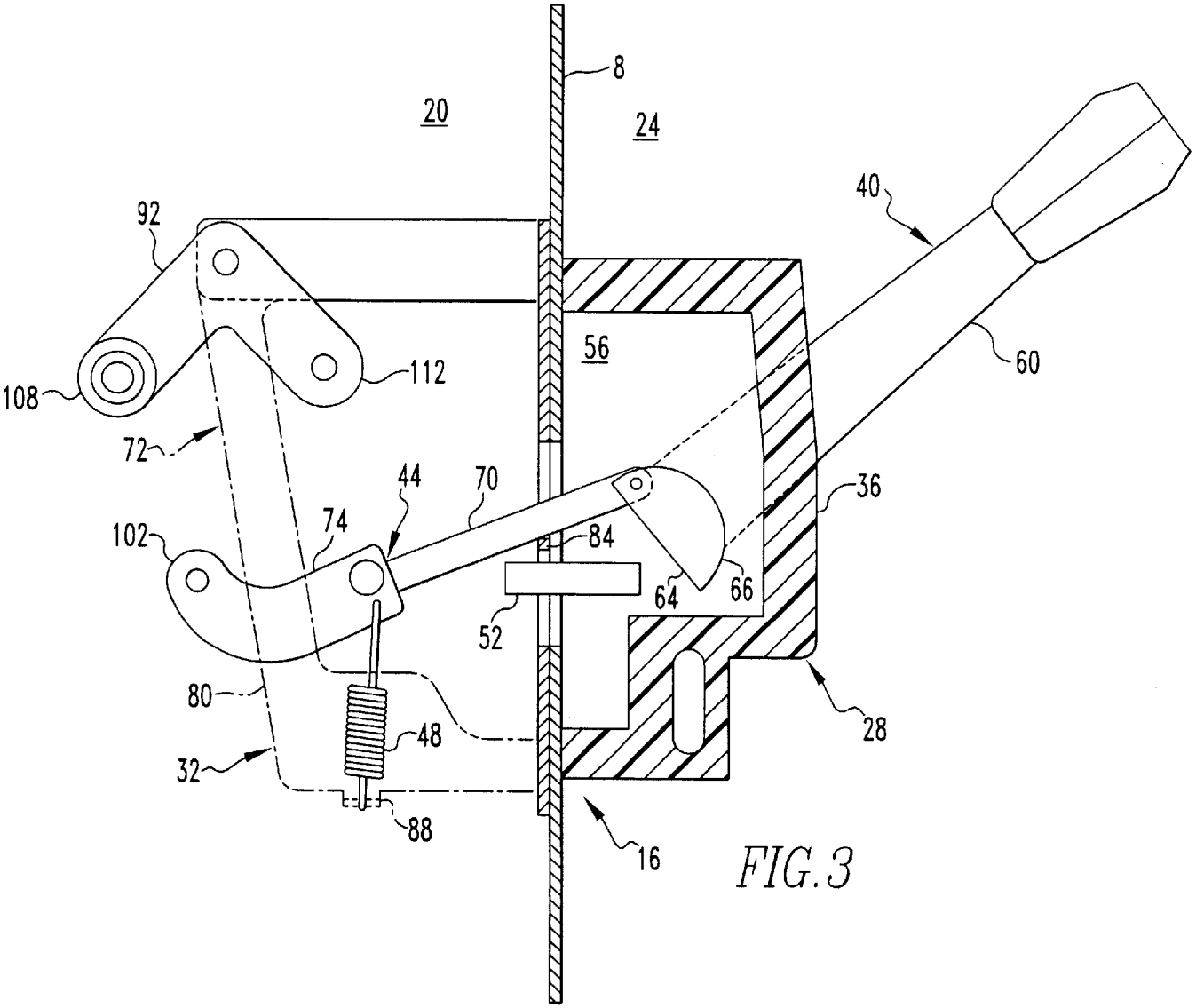
FIG. 3 is a schematic side elevational view of the remote actuator, partially cut away, with a transfer link of the remote actuator being in a first position.
Figure 4:
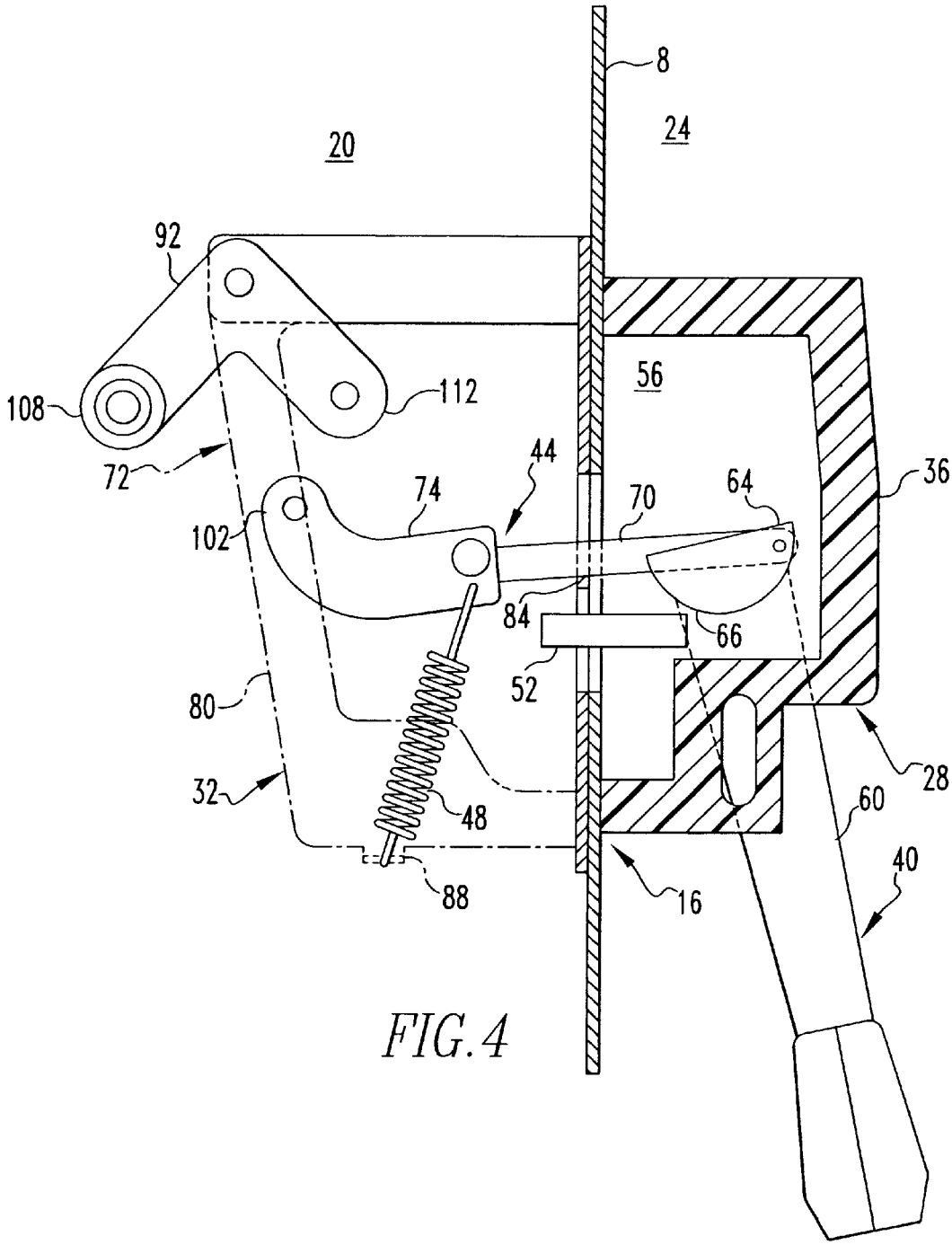
FIG. 4 is a view similar to FIG. 3, except depicting the transfer link in a second position.
Figure 5:
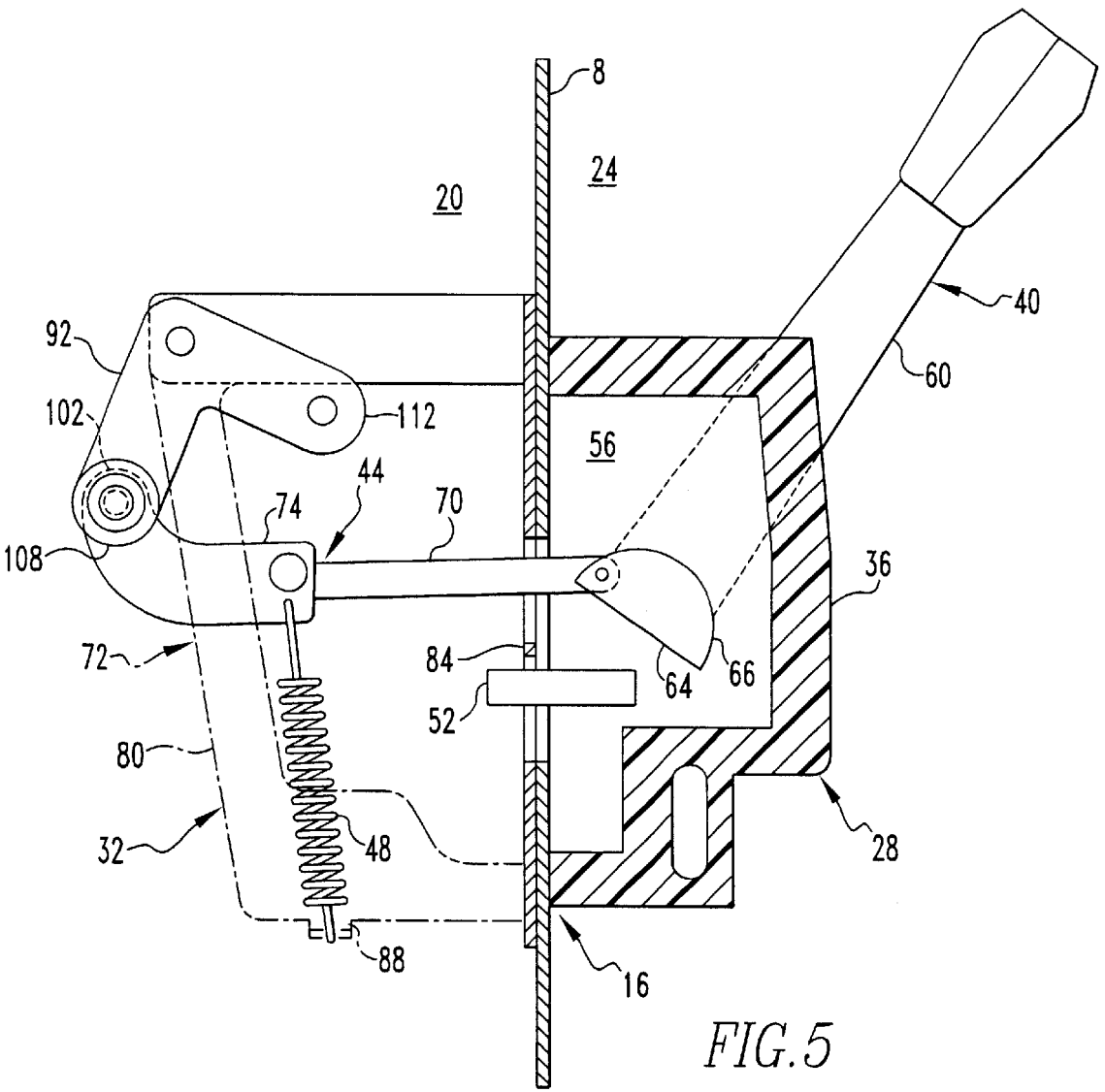
FIG. 5 is a schematic side elevational view, partially cut away, of a portion of the remote actuator in an OFF position after attachment of the transfer link to a bell crank.

As is best shown in FIG. 1, the handle assembly 28 includes a housing 36, and handle 40, a transfer link 44, a spring 48, and a door interlock mechanism 52. The housing 36 is mounted on the cabinet 8, at the exterior 24 thereof, with a pair of mounting fasteners 50. As is best shown in FIGS. 3–5, the housing 36 is formed with a cavity 56 within which some of the components of the handle assembly 28 are at least partially disposed.

Figure 6:
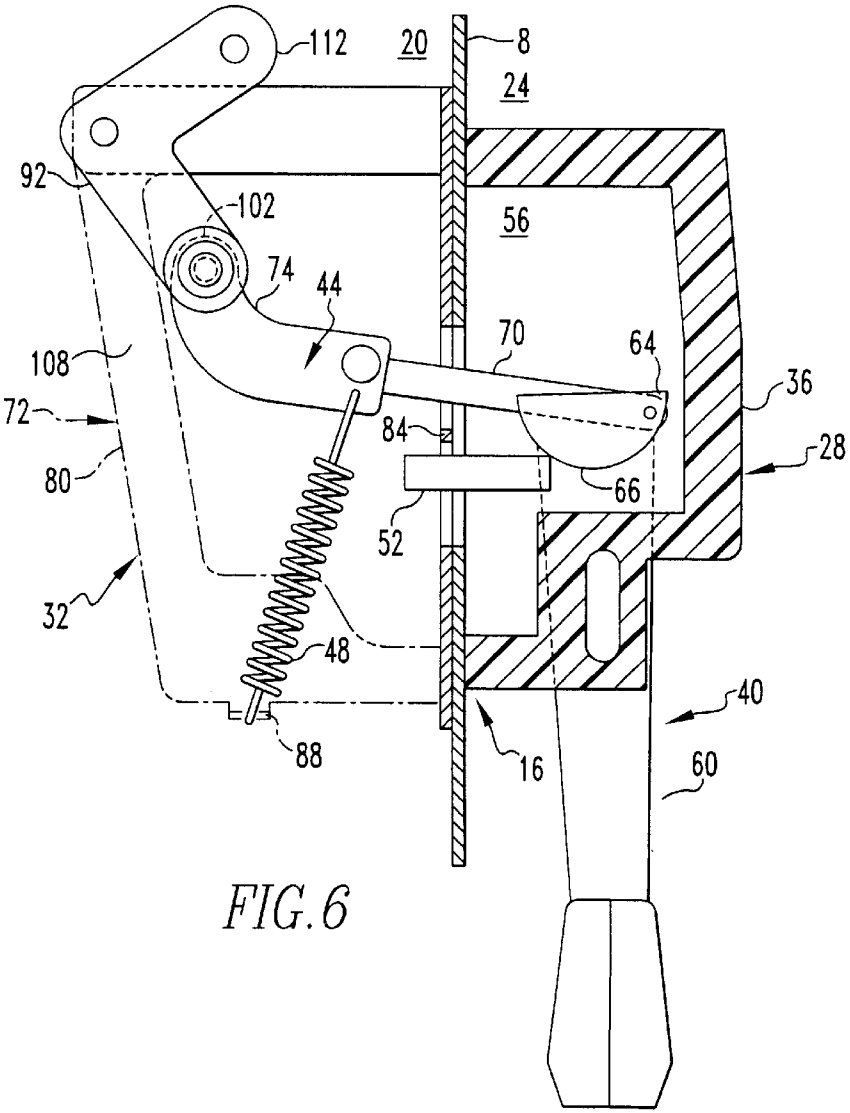
FIG. 6 is a view similar to FIG. 5, except depicting the portion of the remote actuator in an ON position.

The handle 40 includes a lever member 60, a handle crank 64 (FIGS. 3–5), and a pair of pins 68 (FIG. 1). The handle crank 64 is disposed substantially within the cavity 56. The lever member 60 is fixedly attached to the handle crank 64 with the pins 68. The lever member 60 is configured to pivot like a lever between an ON position (FIG. 6) and an OFF position (FIG. 5) and to correspondingly pivot the handle crank 64 therewith. The handle crank 64 includes a camming feature that is cooperable with the door interlock mechanism 52 and that is schematically depicted in the accompanying figures as being the cam surface 66. The cam surface 66 is cooperable with the door interlock mechanism 52 whereby the door interlock mechanism 52 retains a door (not shown) of the cabinet 8 in a closed position unless the lever member 60 is pivoted to the OFF position.

As is best understood from FIG. 1, the transfer link 44 includes a primary link 70 and a connector link 74 connected with one another. The primary link 70 is pivotably mounted on the handle crank 64, as can be seen in FIGS. 3–6. The connector link 74 is fixedly mounted on the free end of the primary link 70. The end of the connector link 74 opposite the handle crank 64 is connectable with the actuation assembly 32 as will be set forth more fully below.

The actuation assembly 32 includes a bracket 72 and a transmission assembly 76. The bracket 72 is mounted on the cabinet 8 at the interior 20 thereof and, in the embodiment depicted in the accompanying figures, is mounted to the cabinet 8 with the mounting fasteners 50.

The bracket 72 includes a frame 80, a fulcrum member 84, and a tab 88 (FIGS. 3–6). It can be seen that the fulcrum member 84 and the tab 88 protrude from the frame 80. As can be in seen in FIGS. 3–5, the fulcrum member 84 is disposed generally between the transfer link 44 and the door interlock mechanism 52.

As can further be seen in FIG. 1, the transmission assembly 76 includes a bell crank 92, a cable assembly 96, and a drive mechanism 100. The bell crank 92 is pivotably mounted on the frame 80. The free end 102 of the transfer link 44 is connected with an attachment fastener 104 to a first end 108 of the bell crank 92. The cable assembly 96 is connected with a second end 112 of the bell crank 92. In this regard, it can be seen that the free end 102 of the transfer link 44 serves as a link attachment portion, and it can further be seen that the first end 108 of the bell crank 92 serves as a transmission attachment portion, whereby the link attachment portion 102 and the transmission attachment portion 108 are connected with one another by the attachment fastener 104 when the remote actuator 16 is fully assembled.

The drive mechanism 100 is schematically depicted in FIGS. 1 and 2. The drive mechanism 100 is connected with the cable assembly 96 and is operatively connected with the circuit breaker 12 in a known fashion.

As is best shown in FIGS. 3–6, the spring 48 extends between and is connected with both of the tab 88 and the transfer link 44. The spring 48 is part of an over-center mechanism that biases the handle 40 to either the ON position or the OFF position in a known fashion.

As can be understood from FIG. 3, in the absence of the fulcrum member 84, a technician or other person charged with assembling the remote actuator 16 would need to manually pivot the transfer link 44 such that the free end 102 of the transfer link 44 would be aligned with the first end 108 of the bell crank 92, and is so doing would need to manually overcome the bias of the spring 48. Within the cramped confines of the frame 80, the application of such force and the effort to align the free end 102 with the first end 108 can be considerable. By providing the fulcrum member 84, however, a substantial portion of the bias of the spring can be overcome by pivoting the lever member 60 such that the transfer link 44 is caused to engage and pivot with respect to the fulcrum member 84. In so doing, it can be seen that the free end 102 of the transfer link 44 can be moved from a first position (FIG. 3) at a first distance from the first end 108 of the bell crank 92 to a second position (FIG. 4) at a second distance from the first end 108, with the second distance being less than the first distance. It can be seen from FIGS. 5 and 6 that the fulcrum member 84 is positioned to not interfere with the operation of the remote actuator 16 when the free end 102 is connected with the first end 108.

Depending upon the specific configuration of the remote actuator 16, pivoting of the lever member 60 from the position shown generally in FIG. 3 to the position shown generally in FIG. 4 may automatically align the free end 102 with the first end 108, although this is not the case with the embodiment of the remote actuator 16 depicted herein. Nevertheless, as can be seen in FIGS. 3 and 4, pivoting of the lever member 60 in the aforementioned fashion serves to overcome at least a portion of the bias of the spring 48, which reduces the amount of effort that would be required of a technician in manually moving the free end 102 into alignment with and attachment to the first end 108 in the absence of the fulcrum member 84. As such, even if the free end 102 is not aligned with the first end 108 when the lever member 60 is in the position depicted generally in FIG. 4, the pivoting of the lever member 60 from the position of FIG. 3 to that of FIG. 4 overcomes at least a portion of the bias of the spring 48, which reduces the effort required in aligning the free end 102 with the first end 108. Specifically, in moving the transfer link 44 from the position depicted in FIG. 4 to that in FIG. 5, a technician generally would be required only to apply sufficient energy to the transfer link 44 to further extend the spring 48 as shown therein, which is substantially less energy than would be required to manually move the transfer link 44 and stretch the spring 48 from the original position depicted in FIG. 3.

Accordingly, the fulcrum member 84 provided on the remote actuator 16 helps to at least partially overcome the bias of the spring 48 during assembly of the remote actuator 16. It thus can be seen that the fulcrum member 84 facilitates assembly of the remote actuator 16.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A remote actuator, the remote actuator being structured to remotely operate a circuit breaker, the remote actuator comprising:

a handle assembly;

the handle assembly including a handle;

the handle assembly including a transfer link;

the transfer link including a link attachment portion;

the handle assembly including a spring;

an actuation assembly;

the actuation assembly including a bracket;

the actuation assembly including a transmission assembly;

the transmission assembly including a transmission attachment portion;

the transmission assembly being structured to be operatively connected with the circuit breaker;

the handle being operatively connected with the transfer link;

the spring biasing the link attachment portion generally away from the transmission attachment portion;

a fulcrum member;

the fulcrum member being disposed on one of the handle assembly and the bracket; and the transfer link being engageable with the fulcrum member to at least partially overcome the bias of the spring and to facilitate operative connection of the transfer link with the transmission assembly by moving the link attachment portion from a first position at a first distance from the transmission attachment portion to a second position at a second distance from the transmission attachment portion, the second distance being less than the first distance.

2. The remote actuator as set forth in claim 1, in which the transfer link is engageable with the fulcrum member upon moving the handle between an on position and an off position.

3. The remote actuator as set forth in claim 1, in which the fulcrum member is disposed on the bracket.

4. The remote actuator as set forth in claim 1, in which the handle assembly includes a door interlock mechanism;

the door interlock mechanism being operatively connected with the handle;

the fulcrum member being disposed between the transfer link and the door interlock mechanism.

5. The remote actuator as set forth in claim 1, in which the fulcrum member is positioned to not interfere with the operation of the remote actuator when the remote actuator is fully assembled.

6. A power distribution assembly comprising:

a cabinet;

the cabinet including an interior;

the cabinet including an exterior;

a circuit breaker;

the circuit breaker being disposed within the interior of the cabinet;

a remote actuator;

the remote actuator including a handle assembly;

the remote actuator including an actuation assembly;

the handle assembly including a handle;

the handle assembly including a transfer link;

the transfer link including a link attachment portion;

the handle being operatively connected with the transfer link;

the handle assembly including a spring;

the actuation assembly including a bracket;

the actuation assembly including a transmission assembly;

the transmission assembly including a transmission attachment portion;

the transmission assembly being operatively connected with the circuit breaker;

the spring biasing the link attachment portion generally away from the transmission attachment portion;

a fulcrum member;

the fulcrum member being disposed on one of the handle assembly and the bracket; and the transfer link being engageable with the fulcrum member to at least partially overcome the bias of the spring and to facilitate operative connection of the transfer link with the transmission assembly by moving the link attachment portion from a first position at a first distance from the transmission attachment portion to a second position at a second distance from the transmission attachment portion, the second distance being less than the first distance.

7. The power distribution assembly as set forth in claim 6, in which the transfer link is engageable with the fulcrum member upon moving the handle between an on position and an off position.

8. The power distribution assembly as set forth in claim 6, in which the fulcrum member is disposed on the bracket.

9. The power distribution assembly as set forth in claim 6, in which the handle assembly includes a door interlock mechanism;

the door interlock mechanism being mounted on the handle;

the transfer link being mounted on the handle;

the fulcrum member being disposed between the transfer link and the door interlock mechanism.

10. The power distribution assembly as set forth in claim 6, in which the fulcrum member is positioned to not interfere with the operation of the remote actuator when the remote actuator is fully assembled.

11. A method of assembling a remote actuator comprising:

providing a handle assembly including a handle, a transfer link, and a spring, the transfer link being operatively connected with the handle;

providing an actuation assembly including a bracket and a transmission assembly;

biasing the transfer link away from the transmission assembly with the spring;

providing a fulcrum member disposed on one of the handle assembly and the bracket;

engaging the transfer link with the fulcrum member;

at least partially overcoming the bias of the spring; and attaching the transfer link to the transmission assembly.

12. The method as set forth in claim 11, in which the step of at least partially overcoming the bias of the spring includes pivoting the transfer link with respect to the fulcrum member.

13. The method as set forth in claim 12, in which the step of pivoting the transfer link includes moving the handle between an on position and an off position.

14. The method as set forth in claim 13, in which the step of moving the handle includes pivoting the handle.

15. The method as set forth in claim 11, in which the step of providing a handle assembly includes providing a door interlock that is operatively connected with the handle;

the step of providing a fulcrum member disposed on one of the handle assembly and the bracket including disposing the fulcrum between the transfer link and the door interlock.

* * * * *